US009802779B2

(12) United States Patent
Lenser

(10) Patent No.: US 9,802,779 B2
(45) Date of Patent: Oct. 31, 2017

(54) METHODS AND SYSTEMS FOR PREVENTING WRINKLES IN A WEB FED THROUGH AN ACCUMULATOR

(71) Applicant: The Procter & Gamble Company, Cincinnati, OH (US)

(72) Inventor: Todd Douglas Lenser, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 397 days.

(21) Appl. No.: 13/868,133

(22) Filed: Apr. 23, 2013

(65) Prior Publication Data

US 2013/0284850 A1 Oct. 31, 2013

Related U.S. Application Data

(60) Provisional application No. 61/639,488, filed on Apr. 27, 2012.

(51) Int. Cl.

| | |
|---|---|
| ***B65H 19/14*** | (2006.01) |
| ***B65H 21/00*** | (2006.01) |
| ***B65H 27/00*** | (2006.01) |

(52) U.S. Cl.

CPC ..... *B65H 19/14* (2013.01); *B65H 21/00* (2013.01); *B65H 27/00* (2013.01); *B65H 2301/46024* (2013.01); *B65H 2401/1121* (2013.01); *B65H 2404/1313* (2013.01); *B65H 2404/152* (2013.01); *B65H 2801/57* (2013.01)

(58) Field of Classification Search

USPC ..... 242/548, 548.3, 566, 615, 615.2, 615.4, 242/552, 554.2

See application file for complete search history.

(56) References Cited

U.S. PATENT DOCUMENTS

| | | | | |
|---|---|---|---|---|
| 4,595,274 | A * | 6/1986 | Sakurai | 399/331 |
| 4,977,656 | A * | 12/1990 | Lioy | B41N 7/00 226/193 |
| 6,371,448 | B1 * | 4/2002 | De Angelis | B66B 7/06 254/374 |
| 2002/0079042 | A1 * | 6/2002 | Hartman et al. | 156/157 |
| 2011/0042012 | A1 * | 2/2011 | Benner et al. | 156/538 |

FOREIGN PATENT DOCUMENTS

| | | | |
|---|---|---|---|
| EP | 0 754 641 | A1 | 1/1997 |
| GB | 0 674 253 | A | 6/1952 |
| GB | 1 457 583 | A | 12/1976 |
| JP | 2010-047372 | A | 3/2010 |
| WO | WO 2005/056447 | A1 | 6/2005 |

OTHER PUBLICATIONS

PCT International Search Report dated Sep. 11, 2013, 10 pages.

* cited by examiner

*Primary Examiner* — William A Rivera
(74) *Attorney, Agent, or Firm* — Charles R. Matson

(57) ABSTRACT

Methods and systems for preventing wrinkles in a web passing through an accumulator. The accumulator comprises a plurality of rollers including at least one roller having an axis of revolution movable toward and away from the axis of revolution of another roller to release and store varying amounts of the web. At least one of the rollers has a nominally flat outer surface and at least one of the rollers has a profiled outer surface.

15 Claims, 7 Drawing Sheets

METHODS AND SYSTEMS FOR PREVENTING WRINKLES IN A WEB FED THROUGH AN ACCUMULATOR

FIELD

The disclosure relates generally to methods and systems for preventing wrinkles in a web fed through an accumulator and, more particularly, to methods and systems for overcoming the tendency of a web to wrinkle or fold over as it is fed to a converting system.

BACKGROUND

The continuous production of disposable absorbent articles, such as diapers, adult incontinence products, and feminine hygiene products generally involves periodic refills of raw materials delivered as a web from a wound roll, particularly for materials such as nonwovens and film stock. When each roll of raw material is nearly depleted, it is necessary to switch to a new roll without disrupting the continuous infeed of web to a converting system. This is typically accomplished by splicing the web of the new roll to the web of the nearly depleted roll using a mechanism well known in the art and commonly referred to as a splice box. An upstream process such as web unwinding and splicing as well as a downstream process such as rewind can both use an accumulator system to store an extra supply of web to be used during such processes.

Intermittent processes can use accumulators before and/or after a process operation to intermittently reduce web speed, in some cases to zero. The accumulator system can commonly take the form of either a linear system with translating rollers or a rotary system with rollers on a stationary arm and a pivotable arm. The translating rollers of a linear system are movable toward and away from one another along a generally linear path to decrease and increase the distance between rollers. Similarly, the rollers on the pivotable arm of a rotary system are movable toward and away from the rollers on the stationary arm along an arcuate path to decrease and increase the distance between rollers. In the case of some processes such as a splicing sequence, the raw material roll having a nearly depleted web supply will slow to a speed lower than full line speed or zero speed for the splicing function which can involve a process of affixing the web of a new roll to the web of the old, nearly depleted roll. The splice process can be via pressure sensitive adhesive, thermal bonding, ultrasonic bonding, pressure bonding or other processes known in the art and commercially available.

During either upstream or downstream processes, the accumulator system provides a continuous feed of the web to or from a converting system by changing the distance between rollers, or idlers, in the web path. The tension in the web and distances between rollers can change considerably during both upstream and downstream processes so such processes can be considered to be highly dynamic. These highly dynamic processes are known to cause out of plane web displacement which can result in web wrinkles, web foldovers, web neckdown, web break-outs, web mistrack, line stops, phase variation of cyclic product features, registration variation of intermittent product features, and defective products. A wrinkle on a roller is any out of plane displacement of the web from the surface of a roller. A foldover on a rollover is defined here as any cross-section of material on a roller where three or more layers of material are present on one cross-section of material on the surface of a roller. A foldover is a type of wrinkle. Due to the wide range of process conditions that can be encountered, these problems have not been adequately addressed in a manner avoiding such adverse consequences. In particular, existing methods to mitigate wrinkle and foldover formation often cause unintended adverse effects, such as web mistrack and high drag forces. Also, it has not been considered possible to utilize lower basis weight webs, thinner webs, and non-homogenous web cross sections due to wrinkling problems presented by highly dynamic accumulation processes, or due to adverse effects of the countermeasures intended to mitigate wrinkling.

If the foregoing adverse consequences could be avoided over the wide range of process conditions encountered in the continuous production of disposable absorbent articles and in the production of raw materials for such disposable absorbent articles, such as diapers, adult incontinence products, and feminine hygiene as well as baby wipes and other such products, it would be possible to significantly reduce manufacturing costs by making it possible to use less expensive materials such as lower basis weight webs, thinner webs, and non-homogenous web cross sections while at the same time reducing equipment cost, increasing line reliability and increasing operating speeds.

SUMMARY

The present disclosure includes methods, systems and rollers for reducing and/or preventing wrinkles in a web passing through an accumulator. The accumulator has a plurality of rollers including at least one roller having an axis of revolution movable toward and away from the axis of revolution of another roller to release and store varying amounts of the web. At least one of the rollers has a nominally flat outer surface and at least one of the rollers has a generally concave profiled outer surface.

The methods, systems and rollers prevent wrinkles or foldovers in an accumulator system having an infeed side and an outfeed side for unwinding a web from a roll. The accumulator system can provide a continuous feed of the web to a downstream converting system and has a plurality of rollers including at least one of the rollers which has an axis of revolution movable generally toward and away from the axis of revolution of another one of the rollers as the web is passing there through. The accumulator system can release and store varying amounts of the web without interrupting the continuous feed of the web to the downstream converting system.

The accumulator system can be provided with at least one roller having a nominally flat outer surface and at least one roller having a profiled outer surface which serves to prevent wrinkles or foldovers in the web as the web is being fed to the downstream converting system. During various upstream and downstream processes, the speed of the web can be varied at either the infeed or discharge side of the accumulator system and the distance between the rollers can be varied by moving one roller toward or away from another roller as the speed of the web at either the infeed or discharge side is varied. For an unwind, the infeed speed can decrease from full line speed to a lower speed or zero, and then increased to full line speed on the infeed side of the accumulator, while the discharge speed remains substantially constant. For a rewind, the speed on the infeed side can stay substantially constant, while the speed on the discharge side is varied from full line speed to a lower speed or zero while rewind rolls are changed. Following such upstream or downstream processes, the speed of the web can be varied at the infeed or discharge side of the accumulator system and the distance between the rollers can be increased by moving the one roller away from the other roller to return the accumulator to a normal condition.

In one embodiment, the accumulator system is a linear system and includes at least one translating roller movable along a generally linear path toward and away from another of the plurality of rollers.

In another embodiment, the accumulator system is a rotary system and includes at least one roller on an arm that rotates or pivots toward and away from at least one roller on another arm that can be stationary or can also rotate or pivot.

In yet another embodiment, at least one roller is a free-spinning idler driven solely by the web as the web is unwinding from the roll, whereas in still another embodiment at least one roller is operatively associated with a driving device as the web is unwinding from the roll.

As still another alternative embodiment, at least one roller can be a free-spinning idler driven solely as a result of contact with the web while at least another can suitably be operatively associated with a driving device as the web is unwinding from the roll.

The rollers in linear or rotary accumulator systems can be cantilevered, simply supported, or a mixture. As shown in FIG. 5 for a linear system and FIG. 2 for a rotary system, the rollers in such a system can be simply supported. As described in Detailed Description below, simply supported idlers provide several functional benefits.

In other respects, the profiled outer surface of the roller shell of at least one roller of the accumulator system can comprise a first radius at or near each of the opposite ends thereof and a second, smaller radius generally intermediate the opposite ends thereof. More specifically, the profiled outer surface of the roller shell can have a generally concave shape and, in particular, the roller shell can be formed to comprise an axial cross-section having an overall shape that is curved, bow tie, V-shaped, or stepped. Further, the plurality of rollers of the accumulator system can be arranged such that between one and three of the rollers having a nominally flat outer surface are disposed along the web path between any two of the rollers having a profiled outer surface.

In yet another respect, a roller is disclosed comprising a roller shell having a profiled outer surface formed of a composite material or an aluminum material. The roller shell can have a first radius at or near each of the opposite ends thereof, a second, smaller radius generally intermediate the opposite ends thereof. Commercially available rollers are insufficient for meeting the functional needs of very low mass, low bearing drag, preventing the formation of wrinkles, and preventing mistrack.

In one form, an accumulator system for preventing wrinkles in a web passing therethrough includes: a plurality of rollers including at least one roller having an axis of revolution movable toward and away from an axis of revolution of another roller to release and store varying amounts of the web; wherein at least two of the plurality of rollers include roller shells having a nominally flat outer surface and at least two of the plurality of rollers include roller shells having a generally concave profiled outer surface; and wherein the at least two rollers with roller shells having a nominally flat outer surface are disposed between the at least two rollers having roller shells having a profiled outer surface.

In another form, an accumulator system for preventing wrinkles in a web passing therethrough includes: a plurality of rollers including at least one roller having an axis of revolution movable toward and away from an axis of revolution of another roller to release and store varying amounts of the web; wherein at least two of the plurality of rollers include roller shells having a nominally flat outer surface and at least two of the plurality of rollers include roller shells having a generally concave profiled outer surface; and wherein the profiled outer surface comprises an axial cross-section with an overall shape that is curved, bow tie, V-shaped, or stepped; and wherein at least one roller having a profiled outer surface is made of a composite material.

In yet another form, a method of preventing wrinkles in a web passing through an accumulator system includes the steps of: arranging two rollers including roller shells having a nominally flat outer surface between two rollers including roller shells having a profiled outer surface; providing at least one roller having an axis of revolution movable toward and away from an axis of revolution of another roller to release and store varying amounts of the web; reducing a distance between the axes by moving the at least one roller toward the other roller; and increasing the distance between the axes by moving the one roller away from the other roller.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings. Some of the figures may have been simplified by the omission of elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings are necessarily to scale. The profile cross-sections in particular are not to scale, to provide better clarity of the shapes of the small magnitude profiles.

DETAILED DESCRIPTION

Figure 1:
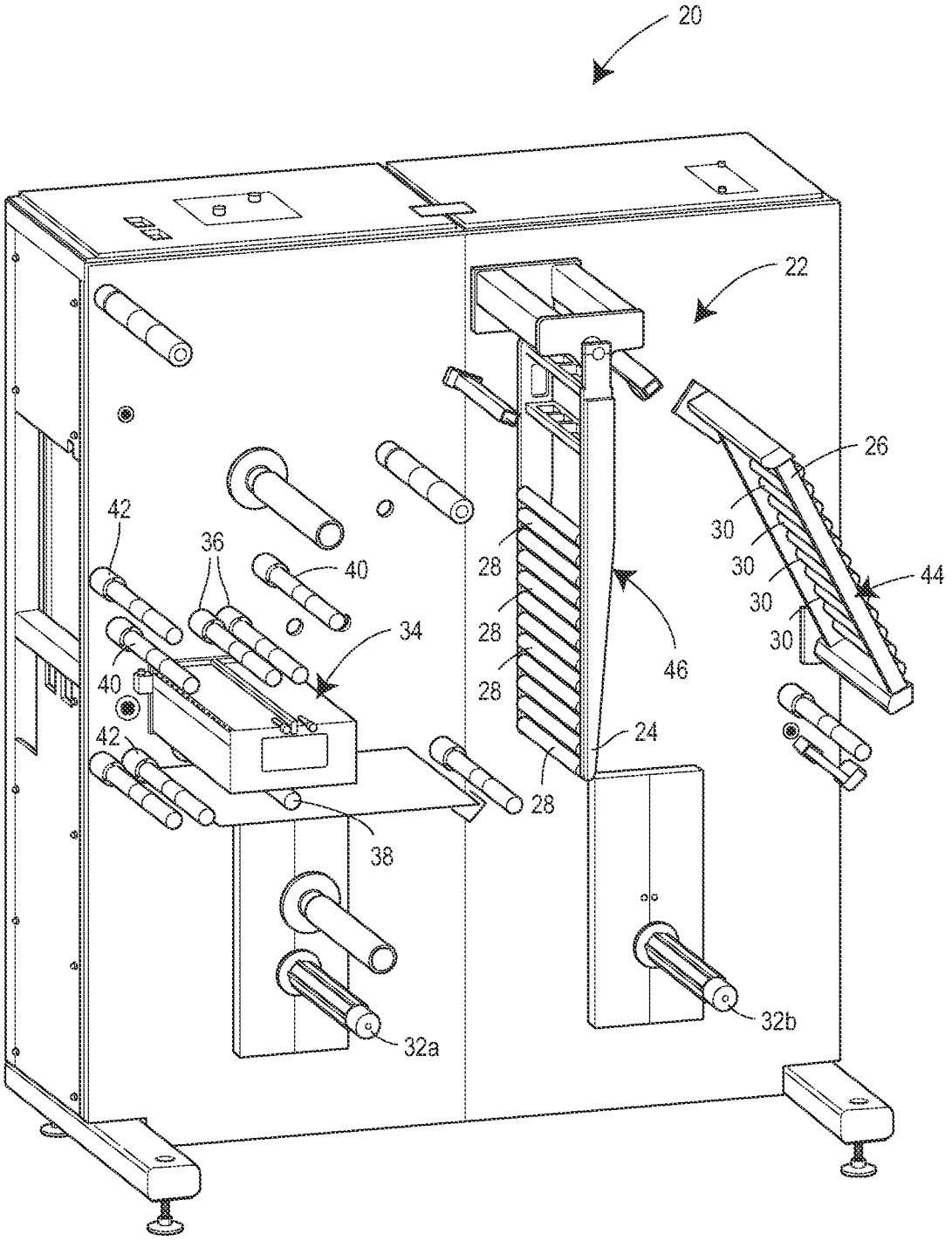
FIG. 1 is a perspective view of a roll stand and rotary accumulator system for unwinding a web from a roll to provide a continuous feed of the web to a converting system.

To fully understand the apparatus and method of the present disclosure, it is useful to know that a significant body of work exists which documents that wrinkle failures in a web passing through an accumulator are cross machine direction buckling failures caused by the stress field inside the web. Generally speaking, it is recognized that any factor which affects the stiffness of the web in a free span or on a roller surface of an accumulator will influence wrinkle formation. Such factors are known to include, but not be limited to span length, web width, web thickness, fiber chemistry, fiber diameter, fiber laydown properties, localized material basis weight variation, localized material thickness variation, and coefficient of friction between a web and the process equipment.

In disposable absorbent product lines, accumulators are a limiting factor, especially when using lower cost, low basis weight, and non-homogenous webs. For such lines, raw material stiffness is often low enough that a web will buckle or form troughs in most free spans between rollers. The web will also often wrinkle and fold over while it is passing over the rollers in an accumulator due primarily to out of plane buckling of the raw material web on the shell surface of the roller because of the intrinsic properties of the web material. Traditional means of preventing buckling are lowering web tension set points, using shorter web spans and using larger diameter idlers. Longer span lengths are significantly more susceptible to wrinkle formation. However, it is generally well known that these steps are impractical for accumulators, especially where it is desired to increase line speeds. As line speeds are increased, an accumulator must generally be able to store more web to make a splice, regardless of whether the splice occurs with the web at a speed lower than full line speed, or zero speed. This means the web span lengths typically grow, such as by making a linear accumulator longer in the displaced direction, by making the arms of a rotary system longer, by increasing the rotating angle of an accumulator arm, or adding more web passes through an accumulator by adding rollers. Increasing roller diameter is not preferable for accumulator systems because larger diameters increase roller inertia and rollers are often driven only by the web. The increased inertia which is caused by increasing roller diameter results in larger tension changes in the web during startup, shutdown, and during the splice sequence. The higher steady state tension which is required to avoid slack web and larger tension spikes during startup, shutdown and splicing leads to increased machine direction stresses in the web. Increased machine direction tension causes increased cross machine direction compressive stresses which is the root cause of buckling on rollers. Ideally, the roller diameter would be decreased in order to reduce inertia, but the reduction of roller diameter has a tendency to induce wrinkles in the process web.

The practical solution disclosed here is to use one or more rollers having a roller shell with a profiled surface in the accumulator and unwind system and, in particular, to use specific patterns of such rollers. The profiled surface of such a roller shell has a smaller radius towards the center and a larger radius towards the ends. The outer surface of such a roller or roller shell is commonly referred to as curved, bow-tie, V-shaped, or stepped, which hereafter will be referred to generically as concave. When the roller is driven only by web tension, it is referred to as an idler, although any idler can be replaced by a driven roller. Concave idlers, i.e., idlers having a concave shell, allow the reduction of idler diameter for reduced rotating inertia, for example from 50 mm outer diameter to 34 mm or less outer diameter for a typical diaper web, or even less for the narrower webs required for other disposable absorbent products. Intrinsically, webs having an insufficient lateral stiffness will tend to produce wrinkles on smaller diameter idlers. By inserting idlers having a shell with a profiled or concave surface into the unwind system, a cross machine direction spreading force will be generated. The cross machine direction spreading force will, in turn, counterbalance the cross machine compressive force.

The specific roller profile is chosen to provide a specific amount of spreading of the web for a given web span length, based on the web material properties, the operating tension range, and the roller diameter. A web span is the web intermediate two rollers or other control points in the web path. The web span length, or distance in product flow, may change during operation if one or more of the rollers or control points is movable, such as occurs in accumulator systems. Additionally, the profile chosen must be realizable by available machining practices and the tolerances in a roller profile generated by such machining. The profile must not have too much radial height difference, such that thicker roller shells are not required to prevent bending of the shell under the web tension and/or for mechanical stability. In addition to the spreading constraint, the profile is also chosen to limit the amount of additional mistrack caused by the profiled roller. Spreading devices, such as the profiled rollers disclosed here, can cause additional mistrack of the web from machine and roller centerline. This induced mistrack is related to the profile design, and can increase when more spreading effect is designed into the profile. Further, the pattern of rollers is designed to balance the desirable effect of preventing wrinkles and foldovers, while minimizing the adverse effects of mistrack caused by the profile induced spreading and minimizing the adverse dynamic tension effects where the profiled idlers add additional roller inertia to the dynamic system.

Other spreading devices such as bowed static bars, often called banana bars, could be used, but would multiply the web tension to excessive levels and, thus, are not acceptable for this purpose. A flexible spreading device, such as the commercial device known as an Arcostretcher® brand roller available from American Roller Company, Union Grove, Wis., United States of America, could be used to spread the web and prevent wrinkles. But such a device has well over 800 grams rotating mass, whereas less than 400 grams per linear meter of idler width is recommended, or even much less. Active spreading devices are possible but, except for the most simple, would add substantial and unacceptable cost to the manufacturing operation, as they would be required in multiple spans. Slat spreading devices are possible, but they have many moving parts, and would increase cost, add complexity, and introduce space requirements. Also, reducing span lengths in an accumulator to reduce foldovers increases idler drag for passive systems because more idlers are needed for a given amount of accumulation.

The solution is to use profiled, thin-walled roller or idler shells in at least one or a plurality of roller or idler locations. A typical concave profile has an overall shape that is curved, bow-tie, V-shaped, or stepped. However, generation of an accurate profile in a thin-walled tube is difficult to accomplish. For metal tubes, the profile can be turned into the surface on a lathe, hydro-formed, or created by shrinking the shell onto a preformed mandrel. A computer numerically controlled lathe can be used to turn the profile. Inspection via surface profilometry utilizing a Coordinate Measuring Machine is recommended.

The radius profiles generated for such thin-walled rollers or idlers can typically be on the order of 20-300 microns (or any integer value of microns between these numbers, or any range formed by any such values) for rollers or idlers of 30-50 mm diameter and web widths of about 100 to 500 mm (or any integer value of mm between these numbers, or any range formed by any such values). For a broad range of web widths, a range of about 0.5% to 2.0% (or any percent value in increments of 0.1% between these numbers, or any range of percentage formed by any such values) of the largest outer roller radius in the section where the web will contact the roller or idler, is a typical magnitude of the radius difference across the profiled roller. In various embodiments, the radius difference across the profiled roller can also be between 0.04% and 5% of the largest outer roller radius, or between 0.05% and 2% of the largest outer roller radius, or between about 0.07% and 1.2% of the largest outer roller radius (or any percent value in increments of 0.01% between any of these numbers, or any range of percentage formed by any such values). As used herein, the term nominally flat refers to an outer surface of a roller or idler that is not configured with a profiled shape (e.g., concave) across the web-contacting portion of its roll face, or that is configured with a minimal profile that does not effectively spread the web.

The roller shell can have a thickness of between about 0.3% and about 20%, between about 0.8% and about 4%, or between about 1.0% and about 3.0% of the largest outer roller diameter, unless the roller is driven. For rollers which are driven, the thickness of the roller shell is not limited. The roller shell nominal thickness can be larger for profiled rollers than flat rollers, as the profile removes material and can allow excessive deflection of the roller surface.

Simply supported rollers provide better control of alignment and reduced frame deflection under load, which mitigates wrinkles. Simply supported rollers have a simpler design, can have lower cost, and can provide higher natural frequencies, which can allow higher line speeds. Simply supported rollers can also allow the use of smaller bearings, which reduces bearing drag forces on the web, which can further allow lower tensions to reduce wrinkle formation. Simply supported idlers can allow bearings to be mounted towards the ends of the roller, which simplifies the internal construction. Cantilevered rollers may be made with the bearings towards the ends, but can also be made with the bearings towards the center of the roller.

Common roller designs can use a dust cap to prevent ingress of large particulates, such as non-woven fibers, into the bearing. An alternative embodiment is to use a stationary dust cap, which has a small clearance to a rotating element, such as the roller shell, bearing, or, the bearing sleeve. The bearing sleeve is defined as the rotatable machine element between the bearing's rotating race, which is normally the outer race but can be the inner race in some embodiments, and the roller shell. Reducing the radius of this split line reduces the relative velocity and the circumference of the line of contact, which reduces drag in operating environments with dust or other contaminants.

Common roller designs use commercial bearings, which may be considered a commodity. Commercial bearings are available in standard sizes, and can use dust shields, dust seals, or have no ingress protection against contamination or for retaining lubrication. Any of these types of bearings may be used. In one embodiment, shielded bearings, such as the E2™ brand Energy Efficient line from SKF Group, Göteborg, Sweden are used to minimize the drag force on the web caused by the frictional moment of the bearings.

Low bearing drag requires that the bearing diameter be minimized. Publicly available information from bearing manufacturers shows that bearing drag varies with bearing mean diameter. Low inertia of the roller requires that the mass of the rotating components of the bearings be minimized. For simply supported designs, the bearings may be made as small as possible, based on commercial sizing tools to provide sufficient bearing life. In some embodiments, the inner race of the bearing can be created directly in the roller shaft, to minimize bearing mean diameter. For cantilevered bearings, this technique can be used on the inboard bearing, to provide a larger minimum shaft diameter with less deflection than a commercial bearing pressed onto a shaft. In one embodiment, the inner race of the inboard bearing is loaded by bending stresses in the cross-machine direction. The inboard bearing inner race is fixed, or prevented from moving in the cross-machine direction. The outboard bearing is floating, or free to move in the cross machine direction. For simply supported designs, one or both bearings can be floating.

In all cases where the idler bearing is floating, common designs use a bearing with a loose fit, such as described in the International Standards Organization (ISO) standard G6, such that the bearing may move in the cross machine direction as required by variation in tolerances of machine elements, assembly variation, or due to thermal changes.

It will be appreciated that any roller can be either a free-spinning idler driven by web tension, or may be a driven roller. A single driven roller can be operatively associated with a motor, or a series of rollers can be operatively associated with one or more motors. When one or more rollers are driven, a load cell roller or other tension device can be used as a feedback device for control of the velocity and or torque applied to the driven roller.

In addition to aluminum and other metals, such profiles can be formed in composite materials such as carbon fiber reinforced plastic, which is commonly referred to as "carbon fiber", although Kevlar® brand para-arimid synthetic fiber available from DuPont DeNemours and Company, Wilmington, Del., United States of America, other arimid synthetic fibers, fiberglass, e-glass, s-glass and the like can be used with a stiffness to weight ratio higher than that of aluminum. The term composite material is used here to refer to any roller shell material which is substantially formed from fibers embedded and joined by a matrix material. Generating a profile in a carbon fiber composite can be done by turning the carbon fiber on a lathe, grinding the profile using a computer numerical controlled grinder, selectively sanding the surface, selectively media blasting the surface, forming the shell on a shaped mandrel, and/or selective winding. In this connection, any of these methods can be utilized with rolled tube prepreg (pre-impregnated synthetic fibers), filament wound material, transverse wound material, or materials which combine any one or more of these formation methods. In one embodiment, a rolled tube of carbon fiber reinforced plastic is formed and cured on a mandrel from a woven prepreg. In one embodiment, the shell is formed of uniaxial carbon fiber, with filaments substantially aligned to the roller axis of revolution, and an outer layer of woven prepreg. The outer layer of woven prepreg limits the size and aspect ratio of any contaminants in the case of damage to the shell.

Generally, computer numerical control (CNC) can be used for grinding the surface of commercially available rolled tube carbon fiber. The roller shell can be supported on a mandrel during machining and grinding operations, to improve tolerances. Quality assurance steps must be in place to prevent voids in the carbon fiber which would result in snags and contamination of the roll with non-woven fibers. The composite fibers of such a roller are generally strong enough to grab nonwoven fibers from a process web.

Regardless of type, the outer roller surfaces of rollers or roller shells can be coated or uncoated or a combination of coated and uncoated. Coatings add mass which can have a tendency to increase web tension spikes for a given acceleration of a roller. Coatings such as thermal spray coatings from Impreglon Inc. of Fairburn, Ga., United States of America, or Plasma Coatings Incorporated of Middlebury, Conn., United States of America tend to increase coefficient of friction. This increase in coefficient of friction can result in wrinkles at lower machine direction tensions. Coatings also can add irregularities to the surface of a roller which may tend to cause wrinkles. However, coatings such as PC-436 or PC-415 from Plasma Coatings Incorporated are useful for preventing web slippage at rollers due to air entrainment. Alternatively, coatings such as epoxy applied to the outside of a composite surface can be used.

In some embodiments, the rollers can have roller shells formed of a metal or aluminum material where possible and a composite material such as carbon fiber, Kevlar®, fiberglass, phenolic materials, reinforced paper or other light weight, high stiffness materials where required by process or deflection considerations.

Previous academic research has provided calculation tools to design profiles sufficient to cause spreading to prevent wrinkles on the surface of a single roller by profiling the surface of the roller using a combination of known design variables. However, this research does not account for the mistrack caused by the spreading rollers. The spreading force of the rollers is generated by the surface velocity profile caused by the radius profile across the roller. The surface velocity profile leads to a machine direction strain profile in the web which varies with the local radius of the roller along its length. This machine direction tension profile generates an in-plane bending moment in the web. When the web material center is not in the same cross machine direction position as the center of the profiled surface each profiled roller causes an additional, non-linear mistrack.

The published research does not account for the range of effectiveness of the spreading force relative to the induced mistrack. In this connection, it is generally known that a profile which is sufficient to prevent wrinkling on a roller often can induce several millimeters of web mistrack. However, profiles flat enough to induce little or no mistrack may generate insufficient bending moment to spread the web and prevent wrinkles. For many types of web handling equipment, a mistrack per span of less than 5-30% of roller width is desired. As the rollers in an accumulator should be well aligned to prevent wrinkles, a mistrack per span of less than about 1% of roller width is typically desired.

In one embodiment, profiled rollers are used in every second, third or fourth position of a web path. In another embodiment, profiled rollers are used in every second or fourth position in the web path, which can allow the profiled rollers to be used only on every position of a stationary frame element of an accumulator or one every other position of a stationary frame element of an accumulator.

By spacing minimally profiled rollers, it has been found to be possible to balance mistrack relative to spreading force. Additionally, on a flat roller downstream of a profiled roller, the ridges in a web are smaller or non-existent immediately after the profiled roller and then larger on each flat roller. When the profiled roller is removed and replaced with a flat roller, all of the flat rollers produce ridges in the web.

From the foregoing, it is believed that there is a transfer of physical properties along a span and, more specifically, it is believed that for a given material the material width off the infeed roller partially determines the material width at the downstream roller of a span. When this material width reaches a critical value, it is believed that the hoop stress of the web on the roller can no longer cause the web to flatten so it begins to deform out of plane which eventually produces wrinkles and/or foldovers. It has been determined that a small level of spreading on the order of about 4 mm per roller at the longest span length is all that is required to prevent wrinkles and foldovers, especially if profiled rollers are located at every second, third or fourth position. In short spans near the parent roll, it is possible to use considerably more spreading, about 20 to about 50 mm of spreading for each meter of web width, to initially spread the web from the parent roll and remove any inwound foldovers.

The range of spreading desired in an accumulator is about 0.5% to about 10% of the material width. The spreading is can be about 1% to about 6% of the material width, or about 1% to about 3% of the material width.

While preventing wrinkles and foldovers, it has also been determined that this spacing minimizes the mistrack otherwise caused by profiled rollers to acceptable levels permitting the use of ultra-low inertia carbon fiber rollers in a small diameter, even without the use of additional tracking devices. In an alternate embodiment, more spreading can be used, and one or more tracking devices, such as commercially available offset pivot guides or camber rolls, can be used to control tracking of the web at one or more roller locations in an accumulator.

In addition to preventing wrinkles and foldovers during the unwinding of a web, it is known that the wrinkles which are wound into raw material parent rolls can also be a problem. It has been determined that by installing profiled rollers in a pattern around a splice box it is possible to induce web spreading to remove such wrinkles. As for the pattern, the first roller after the parent roll can be flat due to the fact that the span length between the parent roll and the first roller varies as the web unwinds from the parent roll. The next rollers downstream of the flat roller are then advantageously profiled in order to spread out any in-wound defects such as wrinkles in the raw material. As a result, it permits the utilization of low cost raw materials which may have internal defects such as wrinkles and, thus, have not been capable of being processed on standard equipment.

It also allows material to be used which is wound at higher strains than are present in the converting processes. Normally, material wound at a high strain has more neckdown and, thus, must be spread to prevent wrinkles. However, it is not always possible to accomplish the needed spreading when using flat rollers alone.

For the special case of films, the use of roller shells formed of a composite material such as carbon fiber or smooth metal presents unique challenges. Carbon fiber and some metal rollers have such a smooth surface that the film tends to float above the idler on a boundary layer of entrained air. This problem can be addressed by using a plasma coating such as PC936 or PC915 from Plasma Coatings Incorporated on the surface of aluminum rollers and alternating the plasma coated aluminum rollers with flat rollers in the dancer system. The plasma coating roughens the surface of the aluminum rollers to provide better traction which also provides lateral stability to the web to thereby ensure consistent tracking whereas the uncoated idlers allow wrinkles to slide out.

The plasma coating is typically uneven and has a tendency to cause wrinkles due to height variations on the surface of the roller. The high coefficient of friction of the plasma coating on the roller also inherently traps wrinkles which would otherwise at least partially spread out on the surface of the roller. However, with a small concave profile, it is possible to alternate plasma coated rollers on one side of an accumulator and concave composite material rollers on the other side of the accumulator to prevent foldovers. Further, the rollers upstream of the splicing device can be a combination of roller types. The roller just before the semi automatic splicing device can be uncoated to provide easy cross direction alignment of a splice to the running web. The two rollers upstream of the roller just before the splicing device can be plasma coated in order to aid in web tracking. The idler after the splicing device and the first idler of the stationary frame can be concave composite material rollers. These spans are critical because the span after the splicing device may be the longest in the system and, thus, most prone to wrinkles.

Throughout the foregoing general discussion and as well as the detailed discussion below making reference to the drawings, it will be appreciated by those skilled in the art that the terms "roller" and "roller shell" and "idler" and "idler shell" are sometimes used interchangeably whereas the "profiled outer surface" comprises the outer surface of the roller shell or idler shell which is one of several components of a roller or an idler along with other components such as a shaft, bearings, and adapters between the shell and bearings.

In the representative illustrations given, and with reference first to FIG. 1, the reference numeral 20 denotes a roll stand having an accumulator system 22 with an infeed side 24 and an outfeed side 26 for unwinding a web from a roll and providing a continuous feed of the web to a downstream converting system. It will be appreciated that the structures disclosed in the representative illustrations are provided for understanding some of a number of applications which require or benefit from the use of an accumulator system and/or a concave profiled roller and, as a result, should not be considered to be limiting.

The accumulator system 22 is a rotary system having a plurality of rollers 28 and 30 including at least one of the rollers 28 having an axis of revolution which is movable toward and away from the axis of revolution of at least another of the rollers 30 to release and store varying amounts of the web. Inside the roll stand 20 are motors (not shown) for driving shafts 32*a* and 32*b* upon which a pair of rolls can be mounted, and at least one controller (not shown) is associated with the motors for reducing the web speed upstream of the infeed side 24 to permit the web of a new roll to be spliced to the web of a nearly depleted roll. As the webs of a new roll and a nearly depleted roll are being spliced, the rotary accumulator system 22 permits web in the accumulator at the time of splicing the webs to be fed continuously and without interruption to the downstream converting system. The rotary accumulator system 22 also includes a device described in more detail below for moving at least one of the rollers 28 toward at least one of the rollers 30 when the speed of the web upstream of the infeed side 24 of the rotary accumulator system 22 is reduced to splice the web of a new roll to the web of a depleted roll. The controller inside the roll stand 20 is then operable to cause the motor to increase the speed of the one of the shafts 32*a* and 32*b* containing the new roll to increase the speed of the web as it leaves the new roll to pass through the rotary accumulator system 22 after the webs have been spliced. The moving device is also then operable to move the rollers 28 away from the rollers 30 as the web speed is increased to increase the distance between rollers wherein at least one of the rollers 28 and 30 has a nominally flat outer surface while at least one of the rollers 28 and 30 has a profiled outer surface.

The rotary accumulator system 22 includes a device 34 for splicing the web of the new roll to the web of the nearly depleted roll and at least one roller 36 upstream of the splicing device 34 and at least one roller 38 downstream of the splicing device 34. The splicing device 34 can comprise a conventional splice box. The roller 36 which is located upstream of the splice box 34 can be uncoated and, in addition, at least two additional rollers 40 and 42, having a traction coating or traction surface, can be located further upstream of the splice box 34.

In one illustrative embodiment, the rotary accumulator system 22 includes a plurality of rollers 30 on a stationary arm 44 which is located immediately downstream of the splicing device 34 and also includes a plurality of rollers 28 on an arm 46 that pivots toward and away from the stationary arm 44. The first roller 30 on the stationary arm 44 which is located immediately downstream of the splicing device 34 and receives the web as it is unwound from the roll can comprise a roller shell formed to have a generally concave profiled outer surface. The generally concave profiled outer surface of this roller shell can take different forms (see, e.g., the roller shells 30*a*', 30*a*", and 30*a*'" illustrated in FIGS. 9-11, 12-14, and 15-17, respectively, which have roller shells with cross-sections that are V-shaped, bow tie-shaped, and curved, respectively.

While various different forms for the roller shell of the first roller 30 on the stationary arm 44 have been illustrated in FIGS. 9-11, 12-14, and 15-17, it will be appreciated that any of the rollers 28 and 30, or any other of the rollers on a roll stand which may benefit from a roller shell such as 30*a*', 30*a*", or 30*a*'" having a generally concave profiled outer surface may, by way of example and not limitation, have cross-sections that are V-shaped, bow tie-shaped, curved, or stepped.

Figure 2:
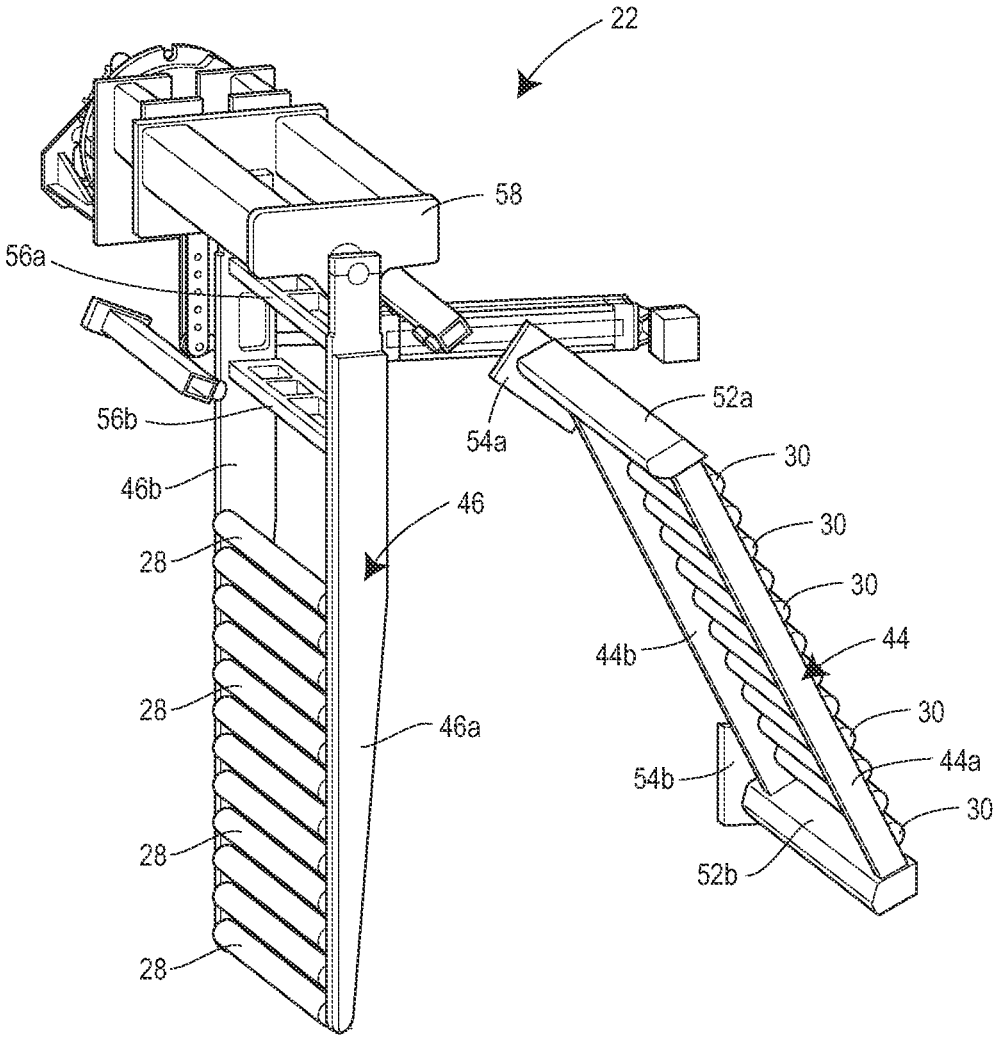
FIG. 2 is an enlarged front perspective view of the rotary accumulator system removed from the roll stand of FIG. 1 and showing additional details of the arm drive mechanism.
Figure 3:
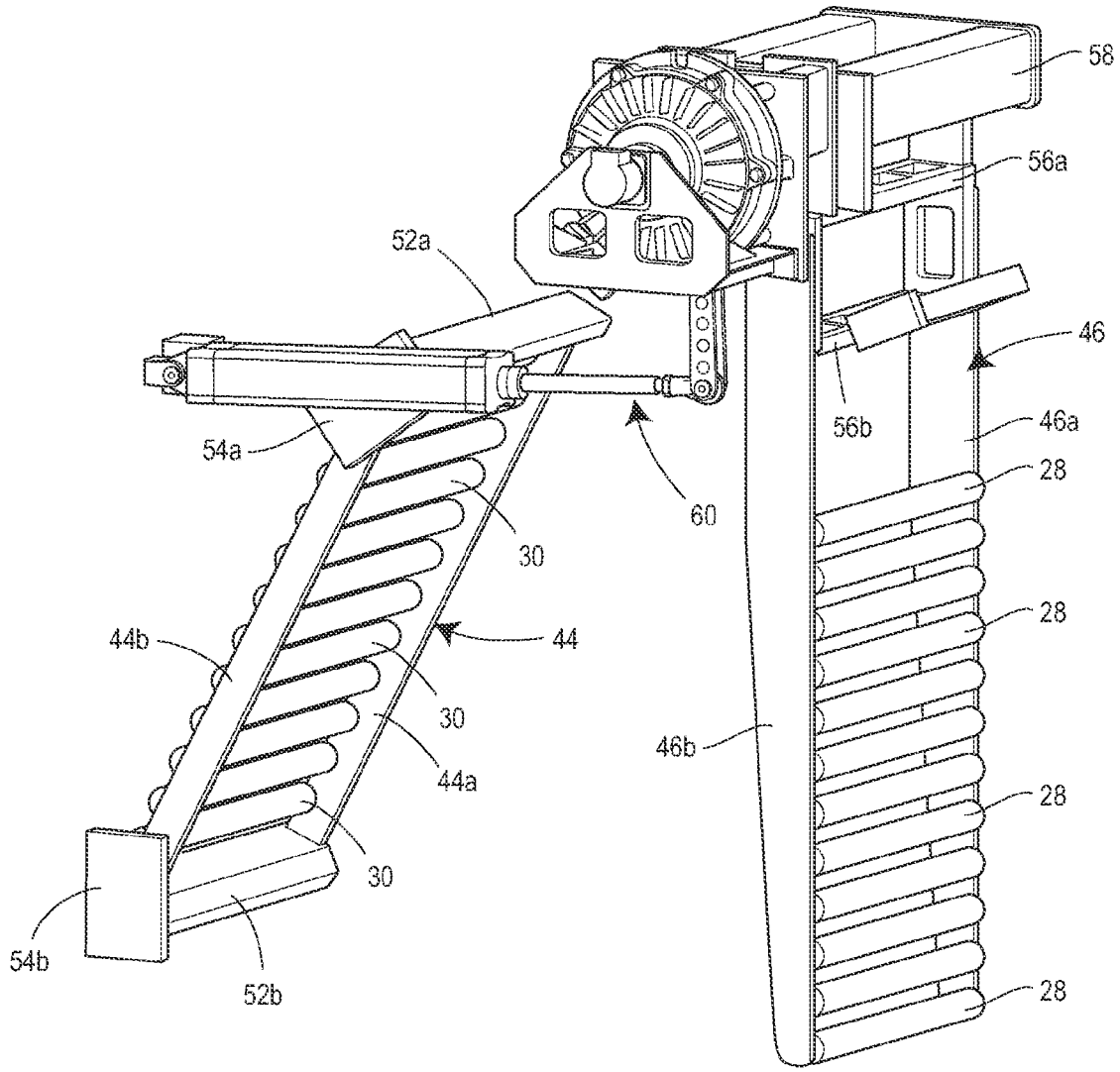
FIG. 3 is an enlarged rear perspective view of the rotary accumulator system removed from the roll stand of FIG. 1 and showing additional details of the arm drive mechanism.

Referring to FIGS. 2 and 3, the stationary arm 44 will be seen to have two parallel arm portions 44*a* and 44*b* and cross supports 52*a* and 52*b* joining the parallel arm portions at opposite ends thereof. It will also be noted that there are two mounting plates 54*a* and 54*b*. The mounting plates 54*a* and 54*b* are secured, e.g., by welding or the like, to the parallel arm portion 44*b* and are provided for securing the stationary arm 44 to the roll stand 20 in any conventional manner.

The pivotable arm 46 will also be seen to have two parallel arm portions 46*a* and 46*b* and cross supports 56*a* and 56*b* for joining the parallel arm portions 46*a* and 46*b* in spaced relation generally at the upper ends thereof. The upper ends of the pivotable arm portions 46*a* and 46*b* are mounted to a fixed support 58 for pivotable movement. As shown in FIG. 3, a rotary drive mechanism designated 60 is associated with the pivotable arm 46 inside the roll stand 20 to cause the pivotable arm to undergo rotary movement toward and away from the stationary arm 44.

Because the rotary drive mechanism is well known to those skilled in the art, it will not be described. The rollers 28 are mounted to the pivotable arm portions 46*a*, 46*b* at their opposite ends for rotational movement in conventional manner and need not be described. Also the rollers 30 are conventionally mounted to the stationary arm portions 44*a*, 44*b* for rotational movement.

Figure 4:
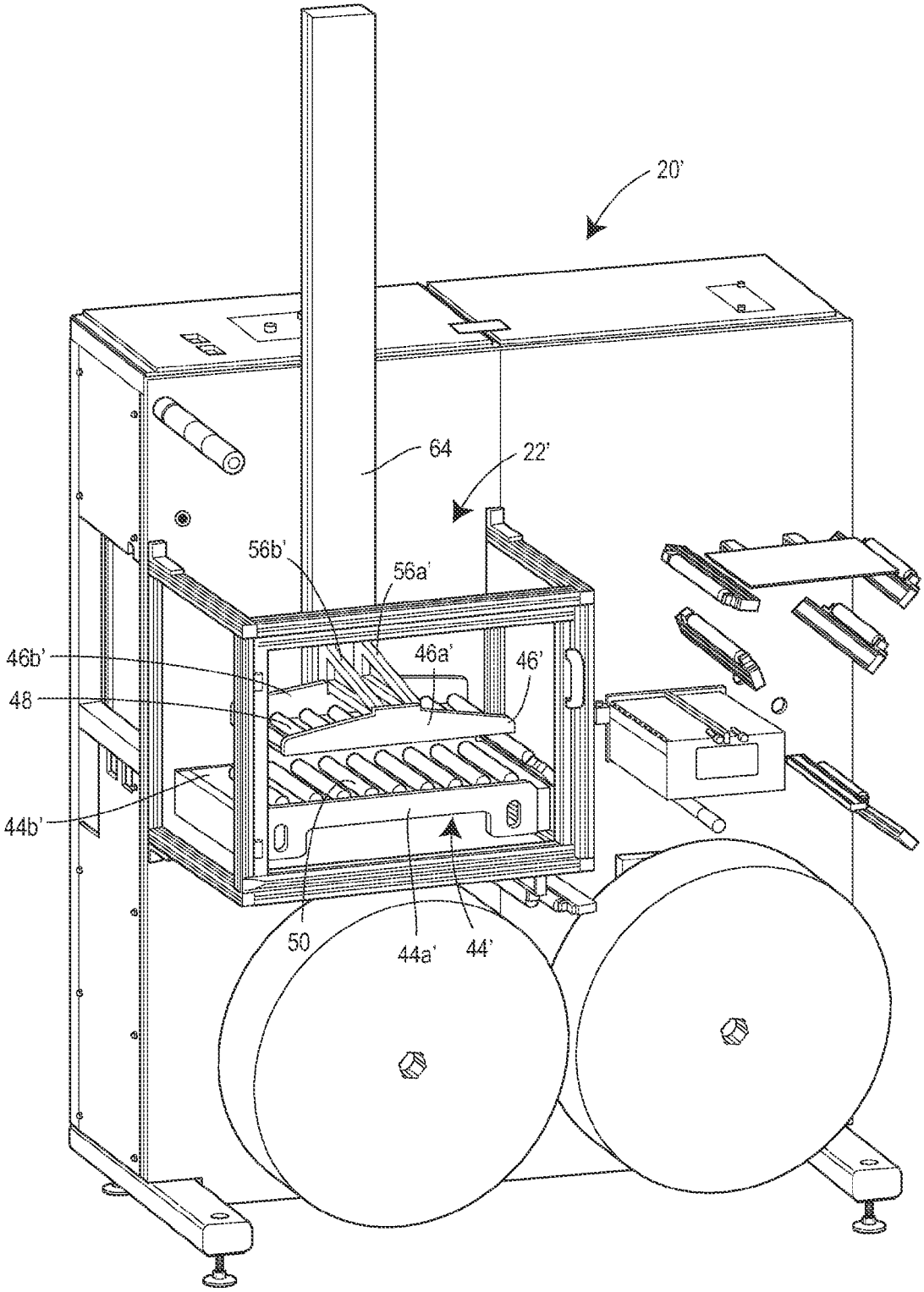
FIG. 4 is a perspective view of a roll stand and linear accumulator system for unwinding a web from a roll to provide a continuous feed of the web to a converting system.
Figure 5:
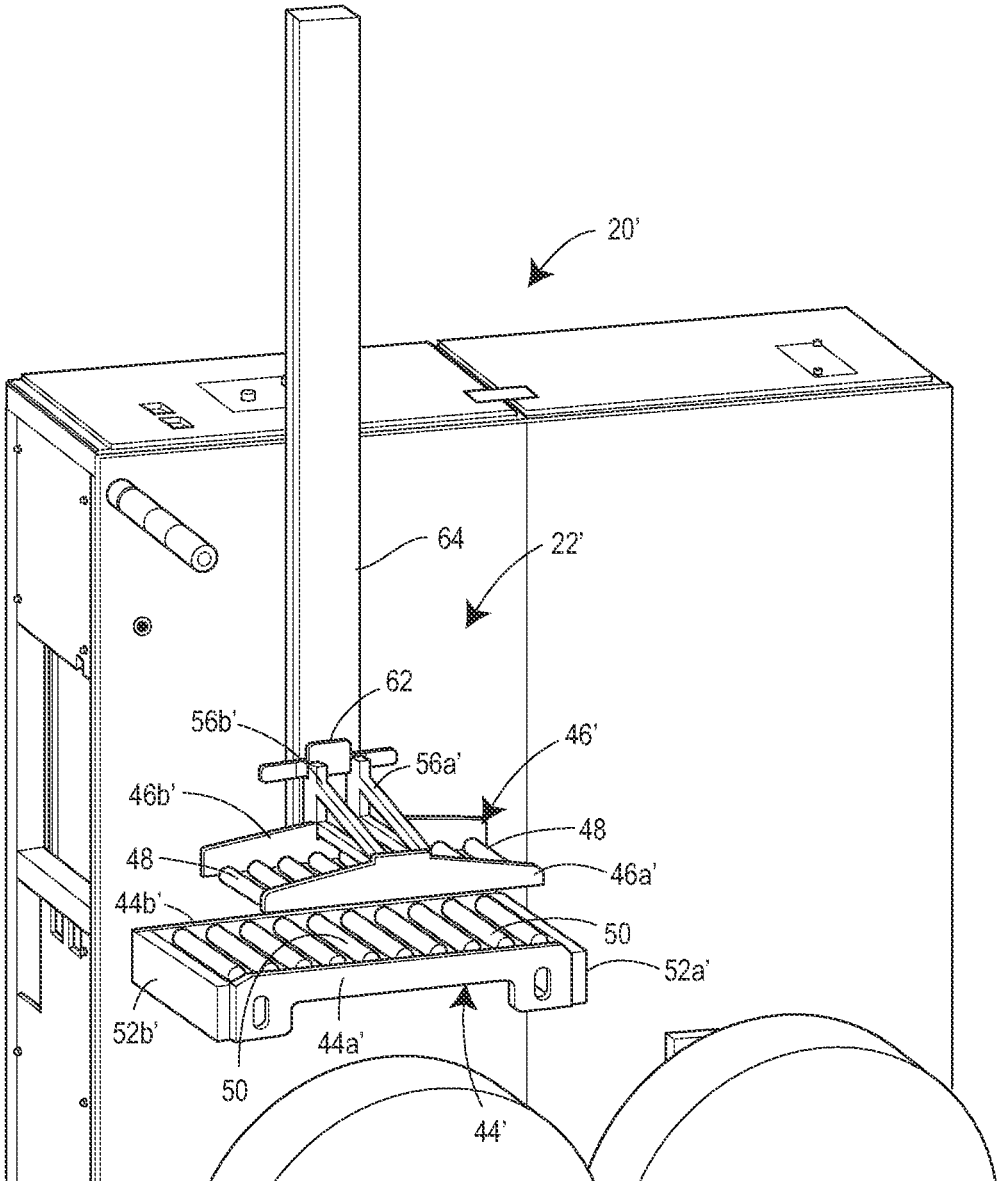
FIG. 5 is an enlarged perspective view of part of the roll stand and linear accumulator system of FIG. 4 with the protective enclosure removed for clarity.

Referring to FIGS. 4 and 5, the accumulator system 22' is a linear system on a roll stand 20', and it comprises a plurality of rollers 48 and 50 including at least one translating roller 48 movable along a generally linear path toward and away from at least another of the rollers 50 to release and store varying amounts of the web. The rollers 48 and 50 of the linear accumulator system 22' generally correspond to the rollers 28 and 30 of the rotary accumulator system 22 with the difference being that the rollers 28 are movable along a generally curved or arcuate path toward and away from the rollers 30 whereas the rollers 48 are movable toward and away from the rollers 50 along a generally linear path. With regard to both the rotary accumulator system 22 illustrated in FIGS. 1-3 and the linear accumulator system 22' illustrated in FIGS. 4-5, the features of their construction and operation are similar in that the rollers 28 and 48 are mounted on movable arms 46 and 46' and the rollers 30 and 50 are mounted on stationary arms 44 and 44'.

Referring to FIGS. 4 and 5, the stationary arm 44' will be seen to have two parallel arm portions 44*a*' and 44*b*' and cross supports 52*a*' and 52*b*' joining the parallel arm portions at opposite ends thereof. There is also a linearly movable arm 46' having two parallel arm portions 46*a*' and 46*b*' and cross supports 56*a*' and 56*b*' joining the parallel arm portions 46*a*' and 46*b*' intermediate opposite ends thereof and a centrally located carriage 62. Referring specifically to FIG. 5, the carriage 62 is mounted on a fixed vertical track 64 on the roll stand 20' for driven movement of the linearly movable arm 46' toward and away from the stationary arm 44'. Because the carriage 62 and track 64 comprising the linear drive mechanism are well known to those skilled in the art, they need not be described herein. Similarly, the rollers 48 are mounted to the arm portions 46*a*' and 46*b*' at the opposite ends thereof in any conventional manner and need not be described herein. Also, the rollers 50 are mounted to the arm portions 44*a*' and 44*b*' of the stationary arm 44' in any conventional manner and need not be described.

While not specifically illustrated in the drawings, it will be appreciated that there are still other types of rotary and linear accumulator systems including ones having two or more arms that are movable toward and away from one another and do not have any stationary arms, and all such systems may benefit from the methods, systems and rollers for preventing wrinkles in a web fed through an accumulator as described herein.

With regard to the sets of rollers 28, 30 and 48, 50, at least one of the plurality of rollers in each set 28, 30 and 48, 50 can comprise a free-spinning idler driven solely by the web as the web is unwinding from the roll. Alternatively, at least one of the plurality of rollers in each set 28, 30 and 48, 50 can be associated with a driving device. Further, the plurality of rollers in each set 28, 30 and 48, 50 can include at least one of the rollers comprising a free-spinning idler and can also include at least one of the rollers being associated with a device for driving the roller.

With regard to the rollers in the sets 28, 30 and 48, 50 which have a roller shell with a concave profiled outer surface, such rollers can be formed to have a first radius at or near each of the opposite ends thereof and a second, smaller radius generally intermediate the opposite ends thereof. This feature of the roller shells for rollers in each of the sets 28, 30 and 48, 50 can be seen and understood by referring to the roller shells 30*a*', 30*a*", and 30*a*'" which are illustrated in FIGS. 9-10, 12-13, and 15-16 and are presented as being representative of such rollers shells. In some embodiments, at least one of the plurality of rollers in the sets 28, 30 and 48, 50 is hollow and the roller shell has a thickness between about 0.4 and 1.2 mm and, in addition, at least one of the plurality of rollers has a roller shell having a traction coating applied thereto or a traction surface formed thereon.

Figure 8:
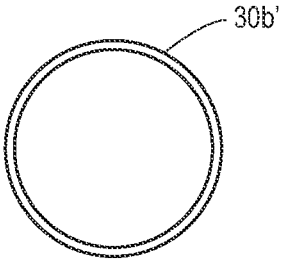
FIG. 8 is an end elevational view of the roller shell of FIG. 6 and further illustrating the roller shell having a nominally flat outer surface.
Figure 6:
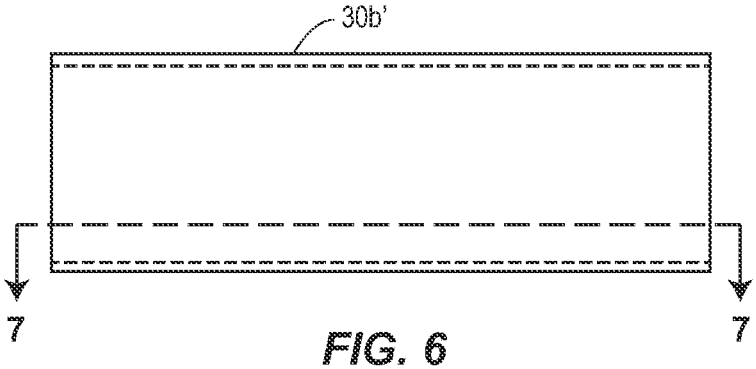
FIG. 6 is a front elevational view of a roller shell for an accumulator system wherein the roller shell has a nominally flat outer surface.
Figure 7:
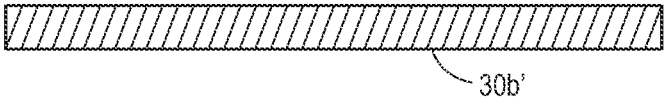
FIG. 7 is a sectional view taken along the line 7-7 of FIG. 6 and further illustrating the roller shell having a nominally flat outer surface.
Figure 11:
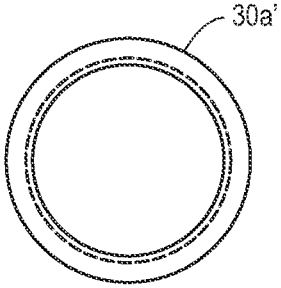
FIG. 11 is an end elevational view of the roller shell of FIG. 9 and further illustrating the roller shell having a V-shaped cross-section.
Figure 9:
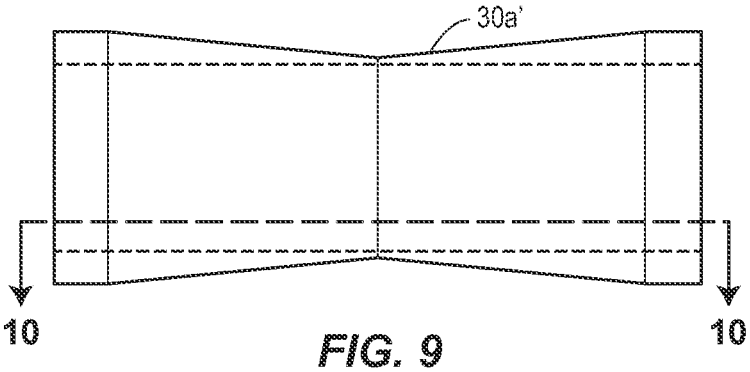
FIG. 9 is a front elevational view of a roller shell for an accumulator system comprising a roller shell having a V-shaped cross-section.
Figure 10:
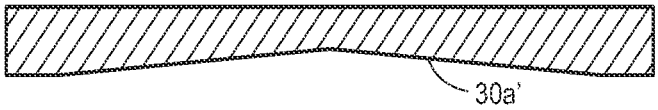
FIG. 10 is a sectional view taken along the line 10-10 of FIG. 9 and further illustrating the roller shell having a V-shaped cross-section.
Figure 14:
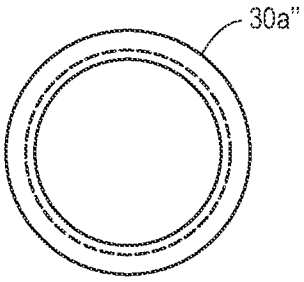
FIG. 14 is an end elevational view of the roller shell of FIG. 12 and further illustrating the roller shell having a bow tie cross-section.
Figure 12:
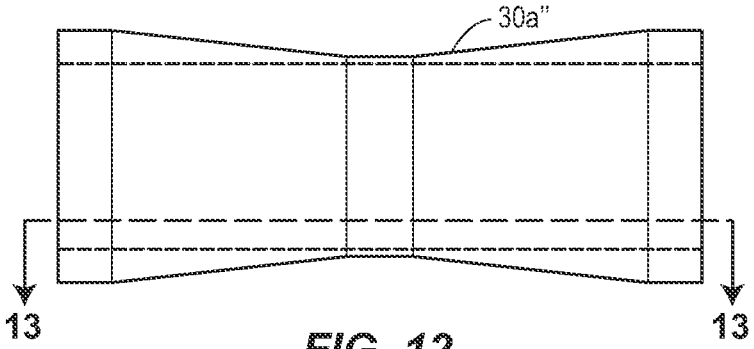
FIG. 12 is a front elevational view of a roller shell for an accumulator system comprising a roller shell having a bow tie cross-section.
Figure 13:
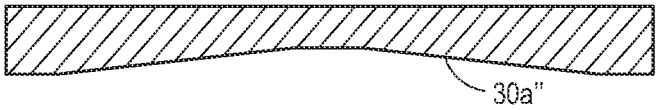
FIG. 13 is a sectional view taken along the line 13-13 of FIG. 12 and further illustrating the roller shell having a bow tie cross-section.
Figure 17:
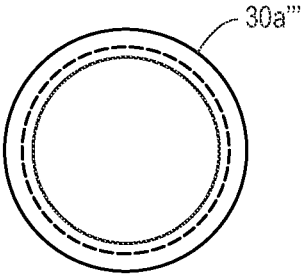
FIG. 17 is an end elevational view of the roller shell of FIG. 15 and further illustrating the roller shell having a concave curved cross-section.
Figure 15:
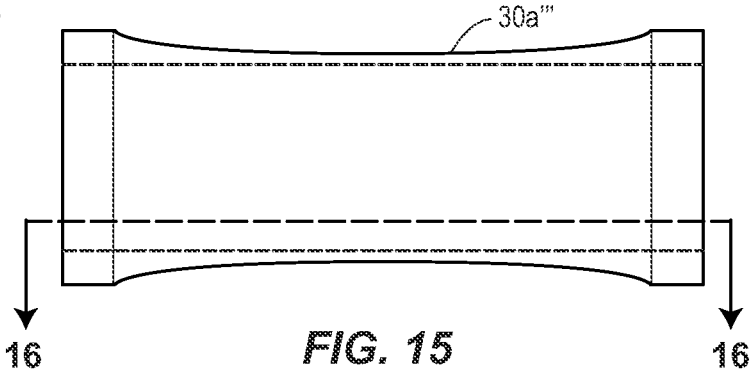
FIG. 15 is a front elevational view of a roller shell for an accumulator system comprising a roller shell having a concave curved cross-section.
Figure 16:
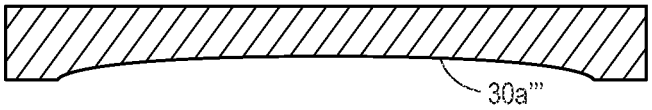
FIG. 16 is a sectional view taken along the line 16-16 of FIG. 15 and further illustrating the roller shell having a concave curved cross-section.

The plurality of rollers in the set 28, 30 of the rotary accumulator system 22 and the plurality of rollers in the set 48, 50 of the linear accumulator system 22' can advantageously include between one and three of the rollers having a nominally flat outer surface disposed between any two of the rollers having a profiled outer surface. By way of example, the rollers comprising roller shells which have a nominally flat outer surface can be formed as illustrated by roller shells 30*b*' in FIGS. 6-8. In addition to having a nominally flat outer surface as illustrated in FIGS. 6-8, at least one of the plurality of rollers which are disposed between any two of the rollers having a profiled outer surface can also comprise a roller shell having a traction coating applied thereto or a traction surface formed thereon in order to achieve better tracking for the web.

The plurality of rollers can comprise rollers having a largest roller outer diameter between about 25 mm and about 60 mm. It is also believed to be advantageous for the roller or rollers which are provided with a profiled outer surface to be formed such that they have a radius difference across the profiled roller of 20-300 microns (or any integer value of microns between these numbers, or any range formed by any such values). In addition, the roller or rollers having a profiled outer surface can comprise a roller shell formed of a carbon fiber or other composite material.

When the roller shell is a composite material, the profiled outer surface can be formed by grinding or turning the outer surface thereof. Alternatively, the profiled outer surface of the roller shell can be provided by forming the roller shell of an aluminum or an aluminum alloy material.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An accumulator system for preventing wrinkles in a web passing therethrough, the accumulator comprising:

a first arm that is stationary;

a second arm;

a first plurality of rollers on the first arm, wherein each roller of the first plurality of rollers is a profiled roller comprising roller shells having a generally concave profiled outer surface;

a second plurality of rollers on the second arm, wherein each roller of the second plurality of rollers is a flat roller comprising roller shells having a nominally flat outer surface and wherein each flat roller comprises a traction coating for increasing the traction of the web on the roller, wherein the traction coating comprises a plasma coating;

wherein each profiled roller is disposed between two flat rollers along a web path extending between the first plurality of rollers and the second plurality of rollers; and wherein the second arm is movable toward and away from the first arm such that the second plurality of rollers is movable toward and away from the first plurality of rollers.

2. The accumulator system of claim 1, further comprising:

a splicing device for splicing a web;

a roller upstream of the splicing device including an uncoated roller shell;

at least two rollers upstream of the splicing device, each of the least two rollers including a roller shell having a traction coating or traction surface; and a roller downstream of the splicing device.

3. The accumulator system of claim 2, wherein:

the plurality of profiled rollers is immediately downstream of the splicing device; and the second arm pivots toward and away from the first arm.

4. The accumulator system of claim 1, wherein at least one of the rollers is hollow; defines a largest roller diameter; and includes a roller shell thickness of 0.8% to 4% of the largest outer roller diameter.

5. The accumulator system of claim 1, wherein at least one profiled roller is made of a composite material.

6. The accumulator system of claim 5, wherein the composite material comprises a carbon fiber composite.

7. The accumulator system of claim 1, further comprising a linear system.

8. The accumulator system of claim 1, further comprising a rotary system.

9. The accumulator system of claim 1, wherein the generally concave profiled outer surface comprises an axial cross-section with an overall shape that is curved, bow tie, V-shaped, or stepped.

10. The accumulator system of claim 1, wherein at least one profiled roller is made of aluminum.

11. The accumulator system of claim 1, wherein the roller shells have a largest roller outer diameter of 25 mm to 60 mm.

12. The accumulator system of claim 1, wherein the generally concave profiled outer surface has a difference between a largest outer roller radius and a smallest outer roller radius of 20-300 microns.

13. The accumulator system of claim 1, wherein the generally concave profiled outer surface has a difference between a largest outer roller radius and a smallest outer roller radius of 50-200 microns.

14. The accumulator system of claim 1, wherein the generally concave profiled outer surface has a radius difference of 0.04% to 5% of a largest outer roller radius.

15. The accumulator system of claim 1, wherein the generally concave profiled outer surface has a radius difference of 0.5% to 2% of the largest outer roller radius.

* * * * *